US005140226A

United States Patent [19]

Lepper et al.

[11] Patent Number: 5,140,226

[45] Date of Patent: Aug. 18, 1992

[54] FLASHING WARNING LIGHT ASSEMBLY

[75] Inventors: Werner Lepper, Erwitte; Dieter Nolte, Geseke; Peter Schulte, Arnsberg, all of Fed. Rep. of Germany

[73] Assignee: Hella KG Hueck & Co., Lippstadt, Fed. Rep. of Germany

[21] Appl. No.: 527,338

[22] Filed: May 23, 1990

[30] Foreign Application Priority Data

May 26, 1989 [DE] Fed. Rep. of Germany ..... 3917062

[51] Int. Cl.[5] ..... H05B 41/34

[52] U.S. Cl. ..... 315/241 R; 315/241 S; 315/200 A

[58] Field of Search ..... 315/241 R, 241 P, 241 S, 315/200 A, 125, 127, 224, 225, 275, 151, 158

[56] References Cited

U.S. PATENT DOCUMENTS

| | | | |
|---|---|---|---|
| 3,644,818 | 2/1972 | Paget | 321/18 |
| 3,846,750 | 11/1974 | Kearsley | 315/241 R |
| 4,194,143 | 3/1980 | Farkas | 315/241 R |
| 4,258,297 | 3/1981 | Nakajima | 315/241 P |
| 4,608,522 | 8/1986 | Yuasa | 315/151 |
| 4,610,521 | 9/1986 | Inoue | 315/241 P |
| 4,660,956 | 4/1987 | Yokonuma | 315/241 P |
| 4,967,177 | 10/1990 | Nguyen | 315/241 S |

FOREIGN PATENT DOCUMENTS 0219999 4/1987 Fed. Rep. of Germany .

*Primary Examiner*—Eugene R. LaRoche
*Assistant Examiner*—A. Zarabian
*Attorney, Agent, or Firm*—Griffin, Branigan & Butler

[57] ABSTRACT

A flashing warning light assembly of a type including a voltage source (s), a transformer gate (W), first and second storage condensers (C1 and C2), flash tube (B), an ignition circuit (T, Z), and an electrical switch (T1) in series with the first storage condenser which is controllable electrically. A monitoring circuit (R1, R2, V1) is further included which senses the charge voltage of the first storage condenser and compares it with a reference voltage, opening the electrical switch when the charge voltage exceeds the reference voltage. The apparatus of this invention provides a flashing warning light assembly which is easily and cost-effectively producible and which, while reliably igniting the flash tube, makes possible the influencing of energy or light intensity of produced light flashes.

19 Claims, 2 Drawing Sheets

FLASHING WARNING LIGHT ASSEMBLY

BACKGROUND OF THE INVENTION

This invention relates to flashing warning light assemblies of a type having a voltage source, a gate transformer, two storage condensers, a flash tube, an ignition triggering circuit, and an electrical switch in series with the first storage condenser.

Such a flashing warning light assembly is well known from U.S. Pat. No. 3,644,818 which has two storage condensers, one of which is connected in series with an electrical switch. When the electrical switch is closed both of the storage condensers are charged with the same charging voltage. When the switch is open, the first storage condenser is charged slower via a resistor than is the second storage condenser. By this means, the electrical energy supplied to a flash tube, and, in turn, the light flash energy, is influenced dependent on the switch setting.

This prior-art flashing light warning assembly has disadvantages. The electrical switch is disclosed therein as being hand actuated and this switch allows, dependent on its switch position, only two possible energy levels which can be stored in the storage condensers. The resistor which causes a slower charging or loading of the first condenser, only leads to a relatively decreased loading of the first storage condenser if the gate transformer is turned off after a preselected time period; when for example the second storage condenser is loaded, that is, a costly control of the gate transformer is necessary. Both condensers of this prior-art flashing warning light assembly must have the same voltage ruggedness, rating, or capacity, even if the first storage condenser is charged to a lower voltage than the second storage condenser. That is, a necessarily expensive first storage condenser will have to be chosen having a large space requirement.

A flashing warning light assembly is described in European Patent A1 0 219 999 in which an electrically controllable switch is provided. This electrically controlled switch affects the charging of a first storage condenser first when a second storage condenser is charged and discharged over a flash tube. By these means a double flash is created in the flash tube with a second produced light flash having a greater intensity than a first produced light flash.

This prior-art flashing light warning assembly has the disadvantage that it is only suitable for producing double light flashes. It is not possible to produce light flashes with changeable energy or flash light intensity.

A purpose of this invention is to produce a flashing warning light assembly which can be easily and cost effectively manufactured and which, while reliably igniting a flash tube, makes possible the substantial influencing of energy or light flash intensity of produced light flashes.

SUMMARY OF THE INVENTION

According to principles of this invention, an electrically controlled switch connected in series with a first storage condenser of a flashing warning light assembly is controlled by a voltage monitoring circuit which senses a charged voltage of the first storage condenser and compares this with a reference voltage, opening the switch when the charged voltage exceeds the reference voltage.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
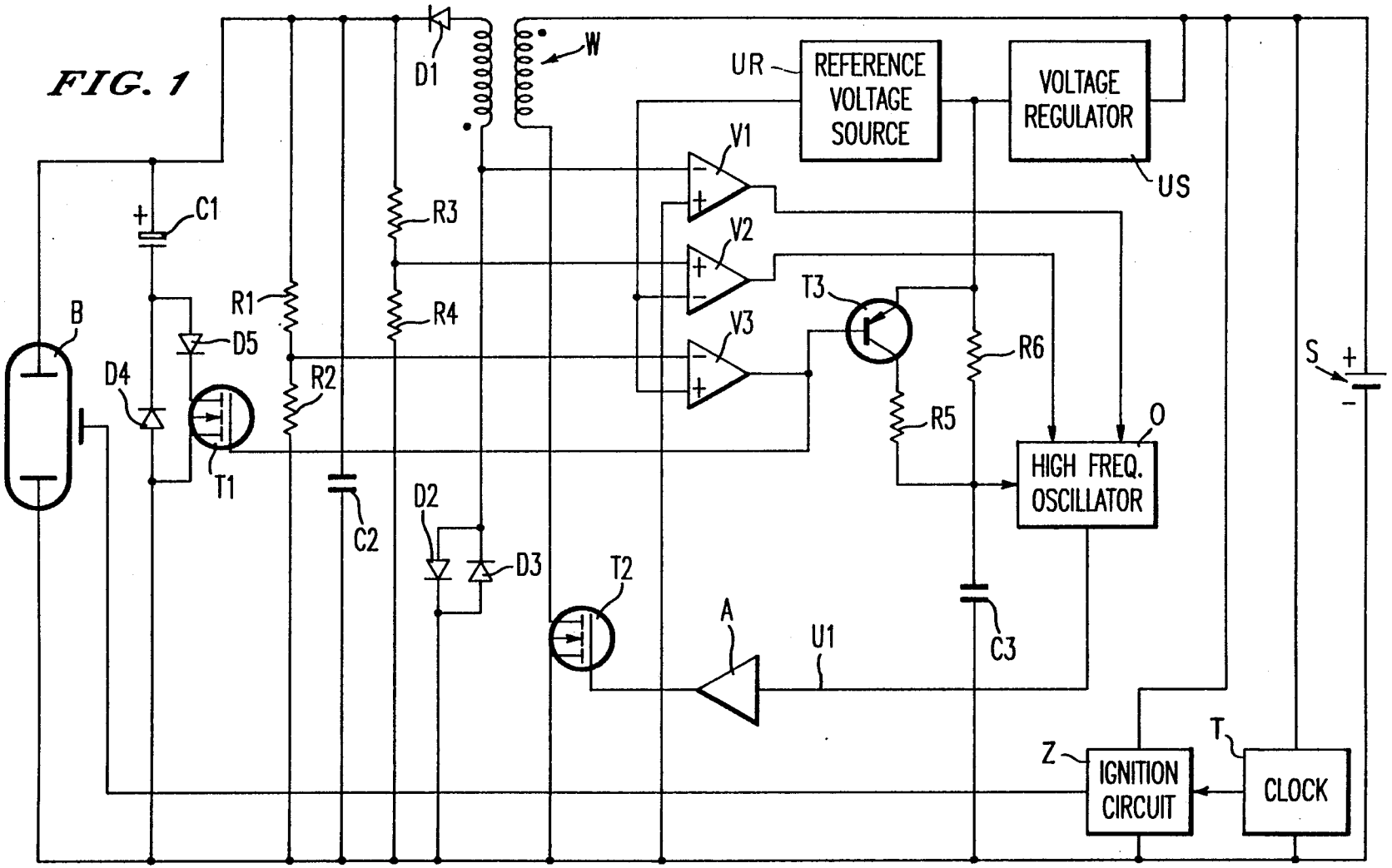
FIG. 1 is a schematic diagram of a flashing warning light assembly of this invention.

In FIG. 1 a positive pole of a voltage source S, which can be a battery of an air vehicle for example, is coupled by a lead with a primary-side winding of a gate transformer W and thence through a second transistor T2, which in a preferred embodiment is a metallic-oxide coated field-effect transistor, to a negative pole of the voltage source S. Voltage is provided from the voltage source S to a clock, or pulse generator, T which creates output signals for controlling an ignition circuit Z, which is also provided with voltage from the voltage source S.

The secondary-side winding of the gate transformer W is connected through a first diode D1, which acts as a rectifier diode, with an anode of a flash tube B whose cathode is connected through a second diode D2 and a third diode D3, which are connected in anti-parallel, back to the secondary winding of the gate transformer W to complete a circuit. The cathode of the flash tube B, the cathode of the second diode D2 and the anode of the third diode D3 are connected by leads in parallel with the negative pole of the voltage source S. The flash tube B includes an ignition electrode which is connected by a lead to the ignition circuit Z.

The cathode of the rectifier diode D1 is connected via a first condenser or capacitor C1, which is used as a storage condenser, and a fourth diode D4, which operates as a discharging diode, with the negative pole of the voltage source S. A first transistor T1, which is a metallic-oxide layer, or coated, field-effect transistor, and which is in parallel with the fourth diode D4, is connected in series with a fifth diode D5. The fifth diode D5 serves to protect the first transistor T1 against overloading during discharge of the first condenser C1.

A voltage divider, comprising first and second resistors R1 and R2, is connected in parallel with the first storage capacitor C1, with these resistors being connected on one side to the cathode of the first diode D1 and on the other side with the negative pole of the voltage source S. A second condenser C2, which is employed as a second storage condenser or helping condenser, is parallel to a second voltage divider comprising a third resistor R3 and a fourth resistor R4 which is connected on one side to the cathode of the rectifier diode D1 and on the other side to the negative pole of the voltage source S.

A voltage at a center tap of the first voltage divider, which comprises the first and second resistors R1 and R2, leads to an inverting input of a first comparator V1 whose non-inverting input is connected by a lead to a reference voltage source UR. An output of the first comparator V1 is coupled to a controlling input of the first metallic-oxide layer field-effect transistor T1 which it controls. In addition, the output of the first comparator V1 is coupled by means of a lead to a base of a third transistor T3 which is a bipolar transistor. The emitter of the third transistor T3 is coupled to a voltage regulator US and to an input of the reference voltage source UR.

The collector of the third transistor T3 is connected via a fifth resistor R5 to a sixth resistor R6, via a third condenser C3 to the negative pole of the voltage source S, and to the input of a high frequency oscillator O.

A voltage on a center tap of the second voltage divider comprising the third resistor R3 and the fourth resistor R4 leads to a non-inverting input of a second comparator V2, whose inverting input is coupled to the output of the reference voltage source UR. The output of the second comparator V2 is coupled via a lead to the high frequency oscillator O. Further, voltage in a connecting lead between the second diode D2, the third diode D3 and the secondary-side winding of the gate transformer W is sensed, or monitored, and fed to an inverting input of a third comparator V3, whose non-inverting input is connected to the negative pole of the voltage source S by means of a lead. An output signal of the third comparator V3 is also fed to the high frequency oscillator O.

The high frequency oscillator O controls, via a driver or amplifier A, the second metallic-oxide layer field-effect transistor T2. Successful control, or steering, depends upon a charging time constant of an RC (resistance/capacitance) circuit formed by the third condenser C3 and the sixth resistor R6 or formed of the third condenser C3 and the sixth resistor R6 in parallel with the fifth resistor R5. Further, the output signal of the high frequency oscillator O is dependent upon the voltage at the center taps of the voltage dividers and, with this, is dependent upon an output signal of the second comparator V2 and the third comparator V3.

Figure 2:
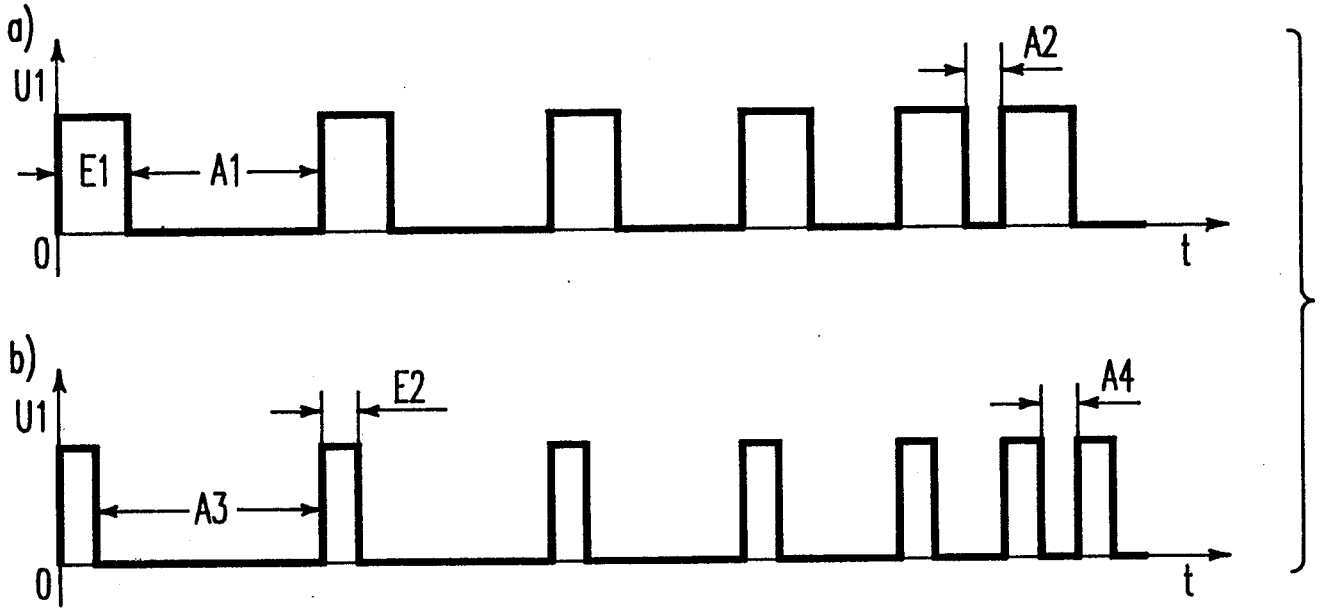
FIG. 2 is a graph showing plots of voltage outputs of an oscillator of the flashing warning light assembly of FIG. 1 versus time.

Operation of the flashing warning light assembly of this invention, as shown in FIG. 1, will now be described using the voltage graphs of FIG. 2;

An output voltage of the high frequency oscillator O is plotted versus time t in plot a of FIG. 2 in which the reference character A identifies off time periods and the reference character E identifies on time periods of the high frequency oscillator O.

It is assumed that at the beginning of this observation the circuit of the flashing warning light assembly of this invention depicted in FIG. 1 is without current. As soon as the voltage source S is connected in the flashing warning light assembly of this invention the high frequency oscillator begins to oscillate and produces an output voltage U1 in accordance with plot a of FIG. 2. In plot a of FIG. 2 the on time periods E1 shown are constant over a first period while the off time periods beginning with A1, are quite long at a beginning of operation but decrease in length with time so that for example, after a certain time has expired a relatively short off time period A2 is reached.

During the first on time period E1 the second transistor T2 is switched via the amplifier A so that the primary-side winding of the gate transformer W has current flowing therethrough. The electrical energy which flows through the primary-side winding of the gate transformer W leads, after opening of the second transistor T2, to a corresponding flow of current in the secondary-side winding of the gate transformer. By properly choosing the number of coils in the primary and secondary windings of the gate transformer W a correspondingly small voltage of the current source S is transformed to a sufficient value for igniting the flash tube B and for charging the first and second storage condensers C1 and C2. The second transistor T2 is opened at the end of the first given on time E1 and the primary-side winding of the gate transformer W is separated from the voltage source S. A unidirectional, or direct, induced current in the secondary winding of the gate transformer flows via the rectifying diode D1 to among others, the first storage condenser C1 and the second storage condenser C2 and charges both of these condensers since at this point in time the first transistor T1 is also closed.

So long as a current flows in the secondary-side winding of the gate transformer W a connecting point between the secondary-side winding of the gate transformer W and the second diode D2 as well as the third diode D3 has a negative potential that is fed to the inverting input of the third comparator V3. The output signal of the third comparator V3 is in this case formed so that the high frequency oscillator is thereby halted. That is, so long as a current flows in the secondary winding of the gate transformer W the oscillator O does not operate and its output signal U1 remains on 0 volt so that the second transistor T2 is blocked.

As soon as the electrical energy in the secondary-side winding of the gate transformer is collected in the storage condensers C1 and C2 the potential at the connection between the secondary-side coil of the gate transformer and the second diode D2 as well as the third diode D3 changes its value so that the output signal of the third comparator V3 takes on an opposite potential than previously and the high frequency oscillator O is set free or released for operation. The result of this is that the output signal of the high frequency oscillator takes on a value of from 0 to various values and the second transistor T2 is turned on again for the first on time period E1. After completion of the first on time period E1 the previously described procedure is repeated. Because the storage condensers C1 and C2 are no longer empty, but rather through the previously described procedure are partially charged with electrical energy, transferring of electrical energy from the gate transformer W into the storage condensers C1 and C2 goes faster with completion of further on time periods E1. The result of this is that the potential at the connection between the secondary-side winding of the gate transformer and the diodes D2 and D3 has a negative value for shorter time periods so that the high frequency oscillator is off shorter periods of time. That is, the off time periods are reduced in length with continued charging of the storage condensers C1 and C2. This leads to the plot of the output voltage U1 of the high frequency oscillator O depicted in plot a of FIG. 2.

The operation described to this point continues until the first storage condenser C1 reaches a preselected stored voltage charge. The charged voltage of the first condenser C1, correspondingly reduced by the first voltage divider comprising the first and second resistors R1 and R2, is sensed or monitored and fed to the first comparator V1. This comparator V1 compares the charge voltage value of the first condenser C1 with a preselected threshold value provided by the reference voltage source UR. As soon as the voltage at the center tap of the first voltage divider, and thereby the chargeable voltage of the first condenser C1, reaches or exceeds the preselected reference voltage, the output signal of the first comparator V1 changes its potential so that the first transistor T1 is thereby opened. It follows that by further turning on the gate transformer W by means of the transistor T2 the induced electrical energy in the secondary winding of the gate transformer W is only fed to the second condenser C2 but no longer to the first condenser C1. That is, as soon as the first transistor T1 is opened, no further charging of the first condenser C1 takes place. As soon as the first comparator V1 appropriately changes its output signal the third transistor T3 is at the same time turned on to conduct. The result of this is that the charging time constant of the RC circuit that previously comprised the sixth resistor R6 and the third condenser C3 is changed because now the fifth resistor R5 is connected in parallel with the resistor R6. The result of this is that the RC circuit for determining the on time period of the high frequency oscillator O no longer comprises the resistor R6 and the condenser C3, but rather comprises the resistor R6 in parallel with the resistor R5 and the condenser C3. This causes the on time periods of the high frequency oscillator O to be shortened as soon as the first condenser C1 is charged. The reduction of the on time periods of the high frequency oscillator has a purpose of preventing an overcharge of the second storage condenser C2. The first storage condenser C1 normally has a large storage capacity and therefore an electrolytic condenser is often used therefor. This condenser however, has a correspondingly smaller voltage capacity or rating. The second storage condenser C2 should ensure reliable ignition of the flash tube B. Therefore the second storage condenser C2 has a correspondingly large voltage capacity or rating. However, its storage capacity is comparatively small.

As long as both storage capacitors C1 and C2 are charged in parallel via the gate transformer W it is beneficial to shorten the charging time with correspondingly large on time periods, such as, for example, the on time periods E1 shown in plot a of FIG. 2, to charge both storage condensers C1 and C2 with large energy thrusts or pulses. As soon, however, as the first condenser C1 is phased out of further charging because of opening of the first transistor T1, and only the second storage condenser is charged via the gate transformer, it is beneficial to shorten the on time period so as to prevent the second condenser C2 from being supplied with large energy thrusts or pulses from the gate transformer W.

If one would not take these measures, in extreme cases, after the first storage condenser C1 is switched off, the second storage condenser C2 would be charged with continued long on time periods until it becomes completely full, or over full, which could lead to over burdening, or overloading, the second storage condenser and possibly lead to its destruction. The correspondingly beneficial reduction of the on time period E is represented in plot b of FIG. 2. There the output voltage U1 of the high frequency oscillator is plotted over time t after the first transistor T1 is opened and the first storage condenser C1 has reached its prescribed charge voltage and will no longer be charged. The on time period E is shown in the plot b of FIG. 2 to be shortened to a second on time period E2 and is in the previously described embodiment only half of the first on time period E1 in plot a of FIG. 2. Because the on time period E2 is shortened at the beginning of phasing out the first storage condenser C1, the off time periods, which are controlled by the third comparator V3 are also shortened so that at the beginning of time when the second storage condenser C2 is charged alone a relatively short third off time period A3 results which, with further continued charging of the second storage condenser C2, shortens still further until, for example, in the course of further charging, a correspondingly shortened fourth off time period A4 results in comparison with the off time period A3.

Also, the second charging voltage of the second storage condenser C2 is monitored or sensed in the inventive flashing warning light assembly of this invention. The second voltage divider is provided for this purpose, which comprises the third resistor R3 and the fourth resistor R4, with a potential at the center tap being directly proportional to the charge voltage of the second storage condenser. This proportional voltage at the center tap of the second voltage divider is fed to the second comparator V2 which compares this potential with a preselected threshold voltage from a reference voltage source UR. This threshold voltage corresponds normally to a maximum charging voltage, such as a voltage rating or voltage capacity of the second storage condenser C2 and is normally chosen according to the choice of the second condenser to provide a reliable igniting voltage to the flash tube.

As soon as the potential at the center tap of the second voltage divider, which corresponds to the charge voltage of the second storage condenser C2, has reached the preselected reference potential, the second comparator V2 changes its output signal at its output and blocks in turn the high frequency oscillator O via an input. This blocking or halting of the high frequency oscillator O remains in place so long as the potential at the center tap of the second voltage divider, which corresponds to the charging voltage of the second condenser, does not fall. It will be understood therefrom that normally the leak rate of normal storage condensers are comparatively small so that the high frequency oscillator O now practically remains turned off until an ignition of the flash tube B over the ignition circuit Z takes place. From this it follows also that, for the selective-production of light flashes of preselected light flash intensity, basically, the previously described charging of the storage condensers C1 and C2 must be completed before the ignition circuit Z sends an ignition impulse over an auxiliary electrode to the flash tube B.

In order to make possible the periodic production of light flashes with the flashing warning light assembly of this invention the clock or pulse generator T is provided which periodically controls the ignition circuit Z. Such a periodic producing of light flashes with a flashing warning light assembly of this invention for example, is particularly necessary with aircraft in which such flashing warning light assemblies can be arranged in wings or in tail sections.

In summary, the attributes of the described embodiment of the inventive flashing warning light assembly are: the on time period of the high frequency oscillator O is variable dependent upon the charge voltage of the first storage condenser. The off time period of the high frequency oscillator O is likewise dependent upon the charging voltages of the first condenser and the second condenser. This is true for a time period in which charging of the storage condensers C1 and C2 takes place as well as for a time period after charging of the storage condensers C1 and C2 until release of a light flash through production of an ignition impulse through the igniting circuit Z.

Since the switch (first transistor) T1 is electrically controllable, this switch can be influenced by further electrical apparatus of the flashing warning light assembly which can thereby control charging of the first condenser. It is inventive that a voltage sensing or monitoring apparatus or circuit is included to monitor the charging voltage of the first storage condenser and to compare it with a preselected reference voltage. This reference voltage can be almost arbitrarily chosen so long as it is lies between the values of 0 volts and a maximum permissible charging voltage for the first storage condenser. Even in an extreme case, the reference potential can correspond to the highest permissible charging voltage of the second storage condenser if the maximum charging potential of the first condenser is chosen to be correspondingly high. The voltage sensing circuit or apparatus opens the electrically controllable switch (T1) when the charge voltage of the preselected reference voltage is reached.

The flashing warning light assembly of this invention has particularly the benefit over prior-art systems that a surer ignition of the flash tube is achieved with a fully-charged second storage condenser having a comparatively smaller storage capacity or rating. The electrical energy to further drive the flash tube is delivered from the first condenser which has a predetermined smaller charge voltage, however a higher storage capacity, than the second storage condenser. The charging voltage of the first storage condenser, and in turn the light energy or light intensity of light flashes of the flashing warning light assembly in distant reaches, are influenced by a given reference voltage.

The flashing warning light assembly of this invention has the further benefit that the maximum charging voltage, that is the voltage capacity or rating of the first storage capacitor can be chosen to be smaller than those of the prior-art because a smaller voltage is sufficient, after a flash tube is ignited, for further driving the flashing warning light assembly to maintain a light curve of the flash tube in comparison with an ignition voltage. Often, the necessary igniting voltage of a flash tube lies around 500 volts while voltage required to maintain gas discharge in a flash tube is around 150 volts. By using the inventive measures of this invention the first storage condenser, in comparison with those of the prior art, can be chosen to be smaller and construction of the flashing warning light assembly of this invention is more convenient than that in prior-art. Also, the first storage condenser of the flashing warning light assembly of this invention requires less space than those of the prior-art.

The voltage sensing or monitoring circuit can beneficially include a voltage divider of two resistors coupled in parallel to the first storage condenser. Voltage given off at a center tap of the voltage divider is proportional to a charging voltage of the first storage condenser, however, in comparison with this charging voltage is comparatively smaller in absolute value. This simplifies further processing of the charging voltage in the monitoring circuit because a comparatively smaller voltage value can be monitored and compared with a relatively smaller preselected reference voltage. The monitoring circuit preferably includes a comparing circuit or comparator which is an off-the-shelf item, freely obtainable. The comparator, in this regard, compares the voltage given off from the middle tap of the voltage divider with a preselected reference voltage and opens the electrical switch when the voltage of the center tap exceeds the reference voltage. The reference voltage can have a relatively small value which is obtained from the same voltage source supplying the primary side of the voltage transformer.

It is further beneficial to employ a protective diode in parallel with the electrical switch so that when a transistor is used as the electrical switch, particularly a field-effect transistor, an overloading of the electrical switch because over-voltage is prevented when the electrical switch is opened.

It is particularly beneficial when an operation control switch is provided for the gate transformer so that the operation control switch reduces the output performance of the gate transformer when the voltage monitoring circuit opens the switch. When a charge voltage of the first storage condenser exceeds a corresponding preselected reference voltage the electrically controlled switch is opened and, when no further measures are provided, the second storage condenser is charged with the full gate transformer output. This charging takes place quite quickly in coarse steps and could lead to an electrical overloading, and possible destruction, of the second storage condenser, because although the voltage rating of the second storage condenser is relatively high its charge capacity is however small. With the described measures, transformer output performance is reduced when only the second storage condenser is charging so that an overloading, and possible destruction, of the second storage condenser is avoided.

It is beneficial for such a performance control circuit to include an oscillator whose output performance, that is its electrical output signal, is changeable depending upon the switch position of the electrical switch. It is particularly beneficial for the performance control switch to include a rectangular-signal oscillator whose output signal is variable in frequency and/or impulse width.

One can further provide a second voltage monitoring circuit which senses a charge voltage on the second storage condenser and compares it with a preselected second reference voltage and turns off the gate transformer when the second storage voltage exceeds the second reference voltage. On the one hand, by using these measures, over charging of the second storage condenser above its maximum charging capacity is prevented. In addition, the flashing warning light assembly of this invention also, through these measures, can simply and cost effectively be adjusted for use with flash tubes having various electrical characteristics as well as with the use of other storage condensers. This serves also to protect the second storage condenser against electrical overloading and destruction.

In this regard, the second voltage monitoring circuit beneficially includes a second voltage divider of two resistors parallel with a second storage condenser. Also here there is the benefit that a voltage monitored at the center tap of the voltage divider is proportional to the charge voltage of the second storage condenser, although, in comparison with the second charging voltage, it has a smaller absolute voltage value which can be more easily and less dangerously used for processing within a second voltage monitoring circuit.

Also the second voltage monitoring circuit can have a second comparator which compares the voltage given off at the center tap of the second voltage divider with a preselected second reference voltage and which turns off the gate transformer when the voltage given off at the second center tap exceeds the second reference voltage. Also, here there is the benefit that a relatively smaller voltage value can be used for the second reference voltage which can be easily and cost effectively derived from the same current and voltage source as the primary side of the voltage transformer.

In order to make possible the periodic repetitive production of light flashes with the flashing warning light assembly of this invention, it is particularly beneficial to use a clock, or pulse generator, for periodically igniting the flash tube. The pulse frequency of the clock, and thereby the flash frequency of the flashing warning light assembly of this invention, is beneficially chosen to be less than the charging frequency for charging the first and second storage condensers in order to achieve a reliable igniting of the flash tube for each light flash on the one hand and on the other hand to produce light flashes with light flash energy of the charge voltage on the first condenser.

It is particularly beneficial for the performance control circuit to have an RC circuit whose charging time constant is changeable by connecting a fifth resistor in parallel with a sixth resistor. This RC circuit ensures a basic frequency with which the gate transformer is controlled. When the electrical switch is closed, the sixth resistor is thereby connected in parallel with the fifth resistor so that the charging time constant of the RC circuit changes and the frequency with which the gate transformer is controlled is changed. In order to achieve this parallel switching of the sixth resistor with the fifth resistor of the RC circuit it is beneficial to provide a third transistor in series with the fifth resistor and parallel to the sixth resistor which is controllable by the voltage monitoring circuit.

While the invention has been particularly shown and described with reference to a preferred embodiment, it will be understood by those skilled in the art that various changes in form and detail may be made therein without departing from the spirit and scope of the invention.

The embodiments of the invention in which an exclusive property or privilege are claimed and defined as follows:

1. In a flashing warning light assembly of a type comprising a voltage source, a gate coupled to the voltage source for controlling transmissions therefrom, first and second storage capacitors coupled to said gate for receiving and being charged by transmissions from said voltage source, a flash tube coupled in parallel with each of said capacitors for receiving discharges therefrom and including an ignition circuit therefor, and an electrical switch in series with said first storage capacitor, the improvement wherein:

said first and second capacitors are connected in lines parallel to one another with said electrical switch being in the parallel line of said first storage capacitor, thereby being parallel to said second storage capacitor;

the electrical switch is electrically controllable;

a first voltage monitoring means is included for sensing a first stored voltage on the first storage capacitor, comparing it with a reference voltage, and opening the electrical switch when the first stored voltage exceeds the reference voltage thereby substantially reducing the further charging of the first storage capacitor.

2. In a flashing warning light assembly as in claim 1 wherein the first voltage monitoring means includes a first voltage divider comprising two resistors connected in parallel with the first storage capacitor.

3. In a flashing warning light assembly as in claim 1 wherein the first voltage monitoring means includes a first comparator.

4. In a flashing warning light assembly as in claim 2 wherein a first comparator is included for comparing a reduced, tap voltage of the first voltage divider with the reference voltage and which opens the electrical switch when the tap voltage of the first voltage divider is greater than the reference voltage.

5. In a flashing warning light assembly as in claim 1 wherein a protective diode is coupled in parallel with the electrical switch.

6. In a flashing warning light assembly as in claim 1 wherein is further included a performance-control-circuit means coupled to the gate for controlling the gate to reduce its output when the voltage monitoring means opens the electrical switch.

7. In a flashing warning light assembly as in claim 6 wherein the performance control circuit includes an oscillator.

8. In a flashing warning light assembly as in claim 7 wherein the oscillator is a rectangular wave oscillator for which frequency and/or pulse width of an output signal can be changed.

9. In a flashing warning light assembly as in claim 6 wherein the performance control circuit includes a resistor-capacitor timing circuit whose timing constant can be changed by coupling and decoupling resistors in parallel.

10. In a flashing warning light assembly as in claim 9 wherein a third electrical switch is coupled in series with one of two parallel resistors which is controlled by the first voltage monitoring means.

11. In a flashing warning light assembly as in claim 1 wherein a second voltage monitoring means is included for sensing a second stored voltage of the second storage capacitor, comparing it with a second reference voltage and turning the gate off when the second stored voltage exceeds the second reference voltage.

12. In a flashing warning light assembly as in claim 11 wherein the second voltage monitoring means includes a second voltage divider comprising two series resistors connected in parallel with the second storage capacitor.

13. In a flashing warning light assembly as in claim 11 wherein the second voltage monitoring means includes a second comparator.

14. In a flashing warning light assembly as in claim 13 wherein the second comparator compares a reduced tap voltage at a second voltage divider connected in parallel with the second storage capacitor with the second reference voltage and turns the gate off when the reduced tap voltage of the second voltage divider reaches the second reference voltage.

15. In a flashing warning light assembly as in claim 1 wherein is further included a clocked pulse circuit for periodically igniting a flash tube.

16. In a flashing warning light assembly as in claim 1 wherein the electrical switch is a transistor.

17. In a flashing warning light assembly as in claim 16 wherein the transistor is a field-effect transistor.

18. In a flashing warning light assembly of a type comprising a voltage source, a gate coupled to the voltage source for controlling transmissions therefrom, first and second storage capacitors coupled to said gate for receiving transmissions from said voltage source, a flash tube coupled in parallel with each of said capacitors including an ignition circuit therefor and an electrical switch in series with said first storage capacitor, the improvement wherein:

the electrical switch is electrically controllable;

a first voltage monitoring means is included for sensing a first stored voltage on the first storage capacitor, comparing it with a reference voltage, and opening the electrical switch when the first stored voltage exceeds the reference voltage;

wherein is further included a performance control circuit for the gate which controls the gate to reduce its output when the voltage monitoring means opens the electrical switch.

19. In a flashing warning light assembly of a type comprising a voltage source, a gate coupled to the voltage source for controlling transmissions therefrom, first and second storage capacitors coupled to said gate for receiving transmissions from said voltage source, a flash tube coupled in parallel with each of said capacitors including an ignition circuit therefor and an electrical switch in series with said first storage capacitor, the improvement wherein:

the electrical switch is electrically controllable;

a first voltage monitoring means is included for sensing a first stored voltage on the first storage capacitor, comparing it with a reference voltage, and opening the electrical switch when the first stored voltage exceeds the reference voltage;

wherein a second voltage monitoring means is included for sensing a second stored voltage of the second storage capacitor, comparing it with a second reference voltage and turning the gate off when the second stored voltage exceeds the second reference voltage.

* * * * *